US007177577B2

(12) United States Patent
Ishiguro et al.

(10) Patent No.: US 7,177,577 B2
(45) Date of Patent: Feb. 13, 2007

(54) PARTICLES SUPPLY APPARATUS AND IMAGE FORMING APPARATUS

(75) Inventors: Yasuyuki Ishiguro, Osaka (JP); Hiroshi Kubota, Osaka (JP); Akira Nakakuma, Nara (JP); Takeshi Takayama, Nara (JP); Jun Yamaguchi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 141 days.

(21) Appl. No.: 11/080,534

(22) Filed: Mar. 16, 2005

(65) Prior Publication Data

US 2005/0207796 A1 Sep. 22, 2005

(30) Foreign Application Priority Data

Mar. 17, 2004 (JP) ..... 2004-076708

(51) Int. Cl.
*G03G 15/00* (2006.01)

(52) U.S. Cl. ..... 399/258; 399/120; 399/260

(58) Field of Classification Search ..... 222/DIG. 1; 399/120, 258, 260
See application file for complete search history.

(56) References Cited

U.S. PATENT DOCUMENTS 6,766,133 B1 * 7/2004 Ban et al. ..... 399/258
6,987,942 B2 * 1/2006 Yoshikawa et al. ..... 399/258

FOREIGN PATENT DOCUMENTS

JP 2000-98722 4/2000
JP 2002-162861 6/2000
JP 2003-280346 10/2003

* cited by examiner

*Primary Examiner*—Hoang Ngo
(74) *Attorney, Agent, or Firm*—Nixon & Vanderhye, P.C.

(57) ABSTRACT

A particles supply apparatus is equipped with cylindrical particles discharge unit(s) provided with particles discharge outlet(s) at lower portion(s) thereof, and is equipped with cylindrical shutter cap(s) covering outside circumferential surface(s) of particles discharge unit(s). Shutter cap(s) is/are provided with opening(s) for opening and/or closing particles discharge outlet(s) of particles discharge unit(s), and shutter cap(s) is/are disposed so as to be capable of moving in substantially parallel fashion with respect to axial direction(s) of particles discharge unit(s) while rotating in helical fashion.

12 Claims, 6 Drawing Sheets

(a)

(b)

PARTICLES SUPPLY APPARATUS AND IMAGE FORMING APPARATUS

BACKGROUND OF INVENTION

This application claims priority under 35 USC 119(a) to patent application No. 2004-76708 filed in Japan on 17 Mar. 2004, the content of which is hereby incorporated herein by reference in its entirety.

The present invention relates to a particles supply apparatus which supplies particles; more particularly, the present invention pertains to a toner particles supply apparatus capable of being used with toner cartridge(s) or the like supplying developer (toner) to development apparatus(es) in copier(s) and/or other such electrophotographic image forming apparatus(es).

Conventional image forming apparatuses employ finely toner particles as developer, removable toner cartridges being used to supply such toner to internal development apparatuses.

As indicated by the partial enlarged view of FIG. 5, such a toner cartridge might be equipped with a cylindrical toner particles discharge unit 102 arranged horizontally beneath the cartridge main body, not shown, which contains the toner. Toner particles discharge unit 102 is provided with toner particles discharge outlet 103 at the bottom circumferential surface thereof. Furthermore, cylindrical shutter cap 110 is mounted on this toner particles discharge unit 102 so as to cover the outside circumferential surface thereof, this shutter cap 110 being disposed so as to permit sliding axially relative to toner particles discharge unit 102. Moreover, when shutter cap 110 is made to overcome an elastic force from thrust spring 120 which is fitted onto the outside of toner particles discharge unit 102 and is made to slide in one direction X1, causing opening 111 formed in shutter cap 110 to line up with the toner particles discharge outlet 103 and open toner particles discharge outlet 103, toner can be supplied to the interior of a development apparatus, not shown, which is arranged beneath toner particles discharge unit 102 (the state shown at (a) in same FIG.). Note that reference numeral 130 in the drawings is the frame of the development apparatus main body.

With a toner cartridge constructed in such fashion, when there is no longer any toner present within the cartridge main body, the toner cartridge is removed from the development apparatus main body and filled with toner, following which it is again loaded into the development apparatus main body. In such case, to prevent leakage from toner particles discharge outlet 103 of toner remaining within the cartridge main body when the toner cartridge is removed from the development apparatus main body, the restoring force from thrust spring 120 causes shutter cap 110 to slide in the other direction X2 (the state shown at (b) in same FIG.) so as to close toner particles discharge outlet 103 (see, e.g., Japanese Patent Application Publication Kokai No. 2000-98722; hereinafter "Patent Reference No. 1").

However, with a construction such as that of the aforementioned Patent Reference No. 1 in which shutter cap 110 is made to slide axially in either direction (X1, X2), there has been the problem that it is possible to cause accidental leakage of toner, since toner particles discharge outlet 103 can be easily opened if shutter cap 110 is inadvertently made to slide in either direction while the toner cartridge is removed from the development apparatus main body.

Toner supply apparatuses have therefore been proposed which solve such problems (see, e.g., Japanese Patent Application Publication Kokai No. 2000-162861; hereinafter "Patent Reference No. 2").

As shown in FIG. 6, such a toner supply apparatus might be constructed such that shutter cap 201 has two directions A, B in which it can slide, sliding in direction B not being permitted until sliding in direction A has first been completed. That is, in terms of sliding direction, the construction is such that this is a two-step process. As a result, since the toner particles discharge outlet cannot easily be opened even when the toner cartridge is removed from the development apparatus main body, it is possible to prevent the problematic situation of accidental leakage of toner.

However, with the aforementioned Patent Reference No. 2, because a two-step mechanism is adopted in which shutter cap 201 slides in two directions A, B, there has been the problem that the structure of the mechanism for causing sliding in those respective directions has been complicated.

Furthermore, with the structure shown in FIG. 5, when the toner cartridge is removed from the development apparatus main body, there has been the problem that toner remaining in the region surrounding opening 111 of shutter cap 110 may fall therefrom and/or sliding of shutter cap 110 may cause toner trapped between the outer circumferential surface of toner particles discharge unit 102 and the inner circumferential surface of shutter cap 110 to fall from opening 111, soiling the surrounding area.

The present invention was conceived in order to solve such problems, it being an object thereof to provide a particles supply apparatus and an image forming apparatus which are such that the particles discharge unit does not easily open even when a force is unexpectedly applied to the shutter cap while the particles supply apparatus, i.e., toner cartridge, is removed from the development apparatus main body, and such that particles does not spill down from the opening in the shutter cap when the particles supply apparatus is removed from the development apparatus main body.

SUMMARY OF INVENTION

A particles supply apparatus in accordance with one or more embodiments of the present invention, being a particles supply apparatus supplying particles, comprises one or more cylindrical particles discharge units arranged horizontally beneath one or more containers containing particles, and provided with one or more particles discharge outlets at one or more lower portions thereof; and one or more cylindrical shutter caps covering at least one outside circumferential surface of at least one of the particles discharge unit or units; wherein at least one of the shutter cap or caps is provided with one or more shutter openings for opening and/or closing at least one of the particles discharge outlet or outlets of at least one of the particles discharge unit or units, and is capable of moving in substantially parallel fashion with respect to at least one axial direction of at least one of the particles discharge unit or units while rotating in helical fashion. By causing the shutter cap(s) to move so as to describe the locus of a helix, such construction makes it possible to open and/or close the shutter cap(s) with a single operation; and furthermore, it is possible to achieve a construction which is such that the shutter cap(s) is/are not easily opened even when an external force is inadvertently applied thereto from a particular direction.

Here, as an example of a mechanism for achieving helical motion, one or more helical grooves might be formed on either at least one outside circumferential surface of at least one of the particles discharge unit or units or at least one inside circumferential surface of at least one of the shutter cap or caps; and one or more sliding projections mating with and sliding within at least one of the groove or grooves might be formed on the other of the at least one outside circumferential surface of at least one of the particles discharge unit or units or the at least one inside circumferential surface of at least one of the shutter cap or caps. Adoption of such a construction will make it possible to cause the shutter cap(s) to smoothly carry out helical motion.

Furthermore, in the foregoing constitution, at least one of the shutter cap or caps may be disposed such that at least one of the shutter opening or openings is positioned upward when at least one of the particles discharge outlet or outlets of at least one of the particles discharge unit or units is in a closed state. When disposed in such fashion, it is possible to prevent the problematic situation in which developer (toner), i.e., particles, adhering to the region surrounding the shutter opening(s) falls therefrom, soiling the surrounding area, when the present particles supply apparatus is removed from the development apparatus main body.

Furthermore, the foregoing constitution may be such that at least one of the shutter cap or caps is substantially constantly acted upon by at least one elastic member exerting at least one restoring force thereon in at least one direction tending to close at least one of the particles discharge outlet or outlets of at least one of the particles discharge unit or units. Where this is the case, an elastic force from the elastic member(s) will cause the shutter cap(s) to close automatically when the present particles supply apparatus is removed from the development apparatus main body, and because a restoring force will act thereon substantially constantly following removal thereof, it will be possible to prevent the shutter cap(s) from opening accidentally even when an external force is inadvertently applied to the shutter cap(s).

Furthermore, in the foregoing constitution, at least one of the shutter cap or caps may be provided with at least one restoring force delivery means delivering at least one restoring force substantially constantly tending to cause at least one of the shutter opening or openings to come in intimate contact with at least one outside circumferential surface of at least one of the particles discharge unit or units. As a result of provision of such restoring force delivery means, when the shutter cap(s) is/are closed, the shutter opening(s) will substantially constantly be made to come in intimate contact with outside circumferential surface(s) of the particles discharge unit(s), and it will be possible to prevent leakage from the shutter opening(s) of particles trapped between outer circumferential surface(s) of the particles discharge unit(s) and inner circumferential surface(s) of the shutter cap(s) as a result of rotation of the shutter cap(s) in helical fashion.

In such case, at least one of the restoring force delivery means may be such that one or more pressure-applying ridges are formed in c-shaped fashion by deforming a portion of at least one circumferential sidewall opposite from at least one of the shutter opening or openings of at least one of the shutter cap or caps which is formed from at least one elastic material; and at least one of the pressure-applying ridge or ridges is formed so as to protrude toward the interior of at least one of the shutter cap or caps. By thus utilizing a portion of the shutter cap(s) to form the restoring force delivery means in integral fashion, the structure of the restoring force delivery means can be simplified and assembly can also be facilitated.

Moreover, particles supply apparatus or apparatuses constructed as described above may be employed as toner cartridge(s) supplying toner to development apparatus(es) of which image forming apparatus(es) is/are comprised. Furthermore, particles supply apparatus or apparatuses constructed as described above may be employed as cleaning apparatus(es) containing waste developer which has been removed from photosensitive drum(s).

BRIEF DESCRIPTION OF DRAWINGS

FIG. 4(*b*) is a partial enlarged bottom view showing positional relationship between toner particles discharge unit and shutter cap when the toner cartridge is removed from the development apparatus main body.

DESCRIPTION OF PREFERRED EMBODIMENTS

Below, an image forming apparatus equipped with a toner particles supply apparatus associated with an embodiment of the present invention is described with reference to the drawings.

Description of Overall Image Forming Apparatus

Figure 1:
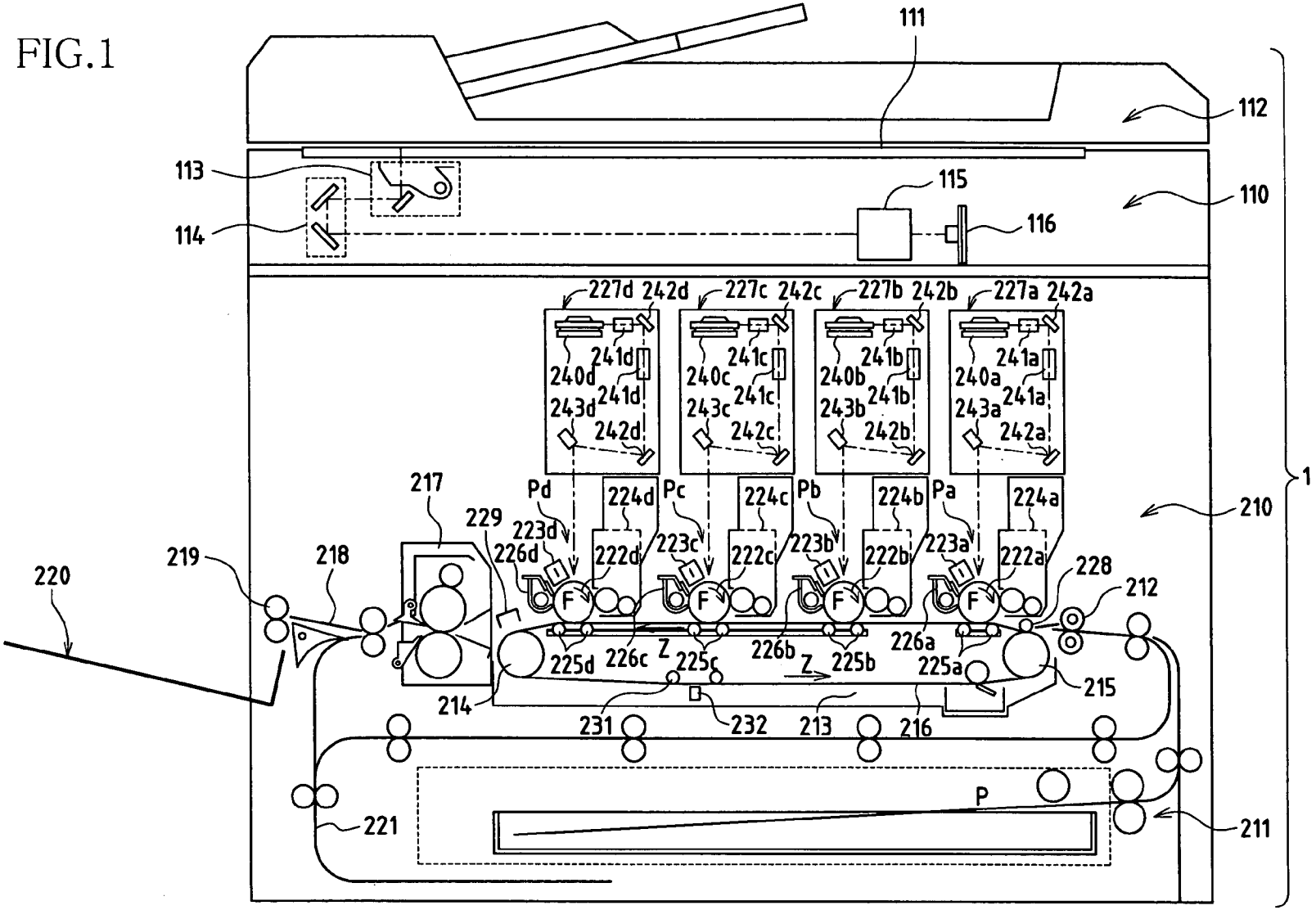
FIG. 1 is a schematic sectional diagram showing the constitution of a digital color copier associated with an embodiment of the present invention.

FIG. 1 is a schematic sectional diagram showing the constitution of a digital color copier (hereinafter simply "copier") 1 serving as color image forming apparatus associated with the present embodiment. This copier 1 is constructed such that it is equipped with reversing automatic document feeder (RADF) 112, image capturing unit 110, and image forming unit 210.

Provided at the top of the main body of copier 1 are original stage 111 and a control panel, described below. Furthermore, reversing automatic document feeder 112 is supported above original stage 111 so as to permit opening and closing thereof relative to this original stage 111.

Reversing automatic document feeder 112 first transports an original so as to cause one side of the original to oppose image capturing unit 110 at a prescribed location on original stage 111. Moreover, after the one side thereof has been subjected to image capture, the original is flipped and is transported toward original stage 111 so as to cause the other side thereof to oppose image capturing unit 110 at the prescribed location on original stage 111. Moreover, after both sides of an original have been subjected to image capture, reversing automatic document feeder 112 discharges this original and carries out double-sided transport operations on the next original. Such operations for original transport and flipping so as to reverse front and back sides thereof are controlled in coordination with overall operations at copier 1.

Image capturing unit 110 is arranged beneath original stage 111 for the purpose of capturing images of originals transported thereto above original stage 111 by reversing automatic document feeder 112. This image capturing unit 110 has original scanning bodies 113, 114 which move in reciprocating fashion parallel to the lower surface of this original stage 111; optical lens 115; and CCD line sensor 116 which is an optical-to-electrical conversion element.

Original scanning bodies 113, 114 comprise first scanning unit 113 and second scanning unit 114. First scanning unit 113 has an exposing lamp which exposes the original image surface; and a first mirror which reflects toward a prescribed direction the image formed by the light reflected from the original. Moreover, this first scanning unit 113 is controlled so as to move in reciprocating fashion at a prescribed scanning speed parallel to the lower surface of original stage 111 while maintaining a constant distance therefrom.

Second scanning unit 114 has a second and a third mirror which further reflect toward a prescribed direction the image formed by the light reflected from the original that has been reflected by the first mirror of first scanning unit 113. This second scanning unit 114 is controlled so as to move in reciprocating fashion parallel to and so as to maintain a constant relative speed with respect to first scanning unit 113.

Optical lens 115 reduces the image formed by the light reflected from the original that has been reflected by the third mirror of second scanning unit 114, the reduced optical image being formed at a prescribed location on CCD line sensor 116. This optical lens 115 may, for example, comprise a plurality of lens groups.

CCD line sensor 116 sequentially carries out optical-to-electrical conversion of the optical image which is formed thereon, outputting this as an electrical signal. This CCD line sensor 116 might, for example, comprise a trilinear color CCD capable of reading a black-and-white image or a color image, and of outputting line scan data wherein colors are separated into respective R (red), G (green), and B (blue) color components. Original image information converted into an electrical signal by this CCD line sensor 116 is, furthermore, transferred to an image processing unit (not shown), where prescribed image data processing is carried out thereon.

Next, constitution of image forming unit 210, and constitution of respective components associated with image forming unit 210, will be described. Provided below image forming unit 210 is paper supply mechanism 211 which separates paper (recording medium/media) P one sheet at a time from where it is stacked within a paper tray and which supplies same toward image forming unit 210. In addition, after having been separated and supplied one sheet at a time, paper P is transported to image forming unit 210, the timing with which this occurs being controlled by a pair of registration rollers 212 arranged at the near side of image forming unit 210. Moreover, after image formation has been carried out on one side thereof, paper P is again supplied and transported to image forming unit 210, the timing with which this occurs being coordinated with image formation at image forming unit 210.

Arranged below image forming unit 210 is transfer/transport belt mechanism 213. Transfer/transport belt mechanism 213 is constructed so as to transport paper P which is made to electrostatically cling to transfer/transport belt 216 suspended so as to extend in more or less parallel fashion between drive roller 214 and idler roller 215. In addition, provided adjacent to the region below transfer/transport belt 216 is an image pattern detection unit.

Moreover, arranged at a point downstream in the paper transport path from transfer/transport belt mechanism 213 is fuser apparatus 217 for fusing onto paper P the toner image which has been transferred and formed on paper P. After passing through the nip formed by a pair of fuser rollers at this fuser apparatus 217, paper P travels by way of switching gate 218, which switches transport direction, to discharge roller(s) 219, which discharge paper P onto discharge tray 220 attached to the outside wall of the main body of copier 1.

Switching gate 218 selectively switches the post-fusing transport path of paper P between a path for discharging paper P to the main body of copier 1, and a path for again supplying paper P toward image forming unit 210. When the transport direction of paper P has been switched by switching gate 218 such that paper P is again directed toward image forming unit 210, paper P is flipped so as to reverse front and back sides thereof by way of switchback transport path 221 and is thereafter again supplied to image forming unit 210.

Furthermore, above transfer/transport belt 216 in image forming unit 210 and near to transfer/transport belt 216 there are, arrayed in order from the upstream side of the paper transport path, first image forming station Pa, second image forming station Pb, third image forming station Pc, and fourth image forming station Pd. Drive roller 214 drives transfer/transport belt 216 in frictional fashion in the direction indicated by arrow Z at FIG. 1 so as to carry paper P, fed thereto via paper supply mechanism 211 as has been described, and sequentially transport paper P to image forming stations Pa through Pd.

Respective image forming stations Pa through Pd have substantially identical constitutions. Respective image forming stations Pa, Pb, Pc, Pd respectively comprise photosensitive drums (photosensitive bodies) 222*a* through 222*d* which are driven in rotational fashion in the direction indicated by arrow F at FIG. 1.

About respective photosensitive drums 222*a* through 222*d* there are, arranged in sequence in the direction of rotation of photosensitive drums 222*a* through 222*d*, charging units 223*a* through 223*d* which respectively uniformly charge photosensitive drums 222*a* through 222*d*; development apparatuses 224*a* through 224*d* which have toner cartridges and which respectively develop electrostatic latent images formed on photosensitive drums 222*a* through 222*d*; transfer electric discharge units 225*a* through 225*d* which transfer toner images developed on photosensitive drums 222*a* through 222*d* to paper P; and cleaning apparatuses 226*a* through 226*d* which remove residual toner from photosensitive drums 222*a* through 222*d*.

Furthermore, respectively provided above respective photosensitive drums 222*a* through 222*d* there are laser scanning units 227*a*, 227*b*, 227*c*, and 227*d*. Laser scanning units (exposure apparatuses) 227*a* through 227*d* comprise semiconductor laser device(s) (not shown) emitting light in the form of dots modulated in correspondence to image data; polygonal mirrors (deflection apparatuses) 240*a* through 240*d* for deflecting, in scan direction(s), laser beam(s) from the semiconductor laser device(s); fθ lenses 241*a* through 241*d* for imaging, onto the surfaces of photosensitive drums 222*a* through 222*d*, the laser beam(s) deflected by polygonal mirrors 240*a* through 240*d*; mirrors 242*a* through 242*d*, 243*a* through 243*d*; and so forth.

A pixel signal corresponding to the black image component of the color original image is input to laser scanning unit 227*a*; a pixel signal corresponding to the cyan image component of the color original image is input to laser scanning unit 227*b*; a pixel signal corresponding to the magenta image component of the color original image is input to laser scanning unit 227*c*; and a pixel signal corresponding to the yellow image component of the color original image is input to laser scanning unit 227*d*. Electrostatic latent images corresponding to original image information converted into colors in this fashion are formed on respective photosensitive drums 222*a* through 222*d*. In addition, development apparatus 224*a* contains black toner, development apparatus 224*b* contains cyan toner, development apparatus 224*c* contains magenta toner, and development apparatus 224*d* contains yellow toner; the electrostatic latent images on photosensitive drums 222*a* through 222*d* being developed by toner of these respective colors. This makes it possible to reproduce, as toner images of respective colors, the original image information which has been converted into colors at image forming unit 210.

Furthermore, provided between first image forming station Pa and paper supply mechanism 211 is paper handling charging unit 228. This paper handling charging unit 228 charges the surface of transfer/transport belt 216. As a result of having been charged by this paper handling charging unit 228, paper P, which is supplied thereto by paper supply mechanism 211, clings definitively to transfer/transport belt 216, in which state paper P is transported without undergoing shifting of position as it goes between first image forming station Pa and fourth image forming station Pd.

Moreover, provided at a region between fourth image forming station Pd and fuser apparatus 217, in a region almost directly above drive roller 214, is charge removal unit 229. An AC current, for separating from transfer/transport belt 216 the paper P which clings electrostatically to transfer/transport belt 216, is applied to this charge removal unit 229.

Cut-sheet paper stock may be used as paper P in the digital color copier constituted as described above. When this paper P is fed from an automatic-feed cassette and is supplied through guide(s) in the paper supply transport path of paper supply mechanism 211, the lead edge portion of this paper P is detected by sensor(s) (not shown), transport thereof being temporarily stopped by registration roller pair 212 based on detection signal(s) output by such sensor(s). Moreover, in coordination with the timing of operations at respective image forming stations Pa through Pd, paper P is delivered onto transfer/transport belt 216, which rotates in the direction indicated by arrow Z at FIG. 1. At such time, because, as has been described, a prescribed charge is applied by paper handling charging unit 228 to transfer/transport belt 216, the force of this electrostatic attraction permits paper P to be transported in stable fashion as it passes through respective image forming stations Pa through Pd.

At respective image forming stations Pa through Pd, toner images of respective colors are respectively formed, transport being carried out so as to cause the toner images of respective colors to be mutually combined in superposed fashion on the support surface of paper P, which clings electrostatically to and is transported by transfer/transport belt 216. When image transfer at fourth image forming station Pd has been completed, a charge removal electric discharge unit causes paper P to separate from transfer/transport belt 216 in sequential fashion beginning with the lead edge portion thereof, following which paper P is guided to fuser apparatus 217. And finally, after the toner image has been fused thereon, paper P is discharged from a paper discharge outlet (not shown) onto discharge tray 220.

Note that, in the constitution described above, laser scanning units 227*a* through 227*d* carry out optical writing on photosensitive drums 222*a* through 222*d*, exposure being carried out through scanning of laser beam(s). In contrast hereto, it is possible to adopt a constitution in which, instead of laser scanning units, an optical write system (LED head(s)) comprising light emitting diode array(s) and imaging lens array(s) is employed. LED heads are smaller in size than laser scanning units, and because there are no moving parts they also excel in quietness. LED heads may therefore be favorably employed in tandem-type digital color copiers and other such image forming apparatuses requiring multiple optical write units.

Description of Toner Cartridge Portion of Development Apparatus Associated with Present Invention Toner particles supply apparatuses in accordance with the present invention may be employed as toner cartridges supplying toner to respective development apparatuses 224*a* through 224*d* in copier 1 having constitution as described above.

Figure 2:
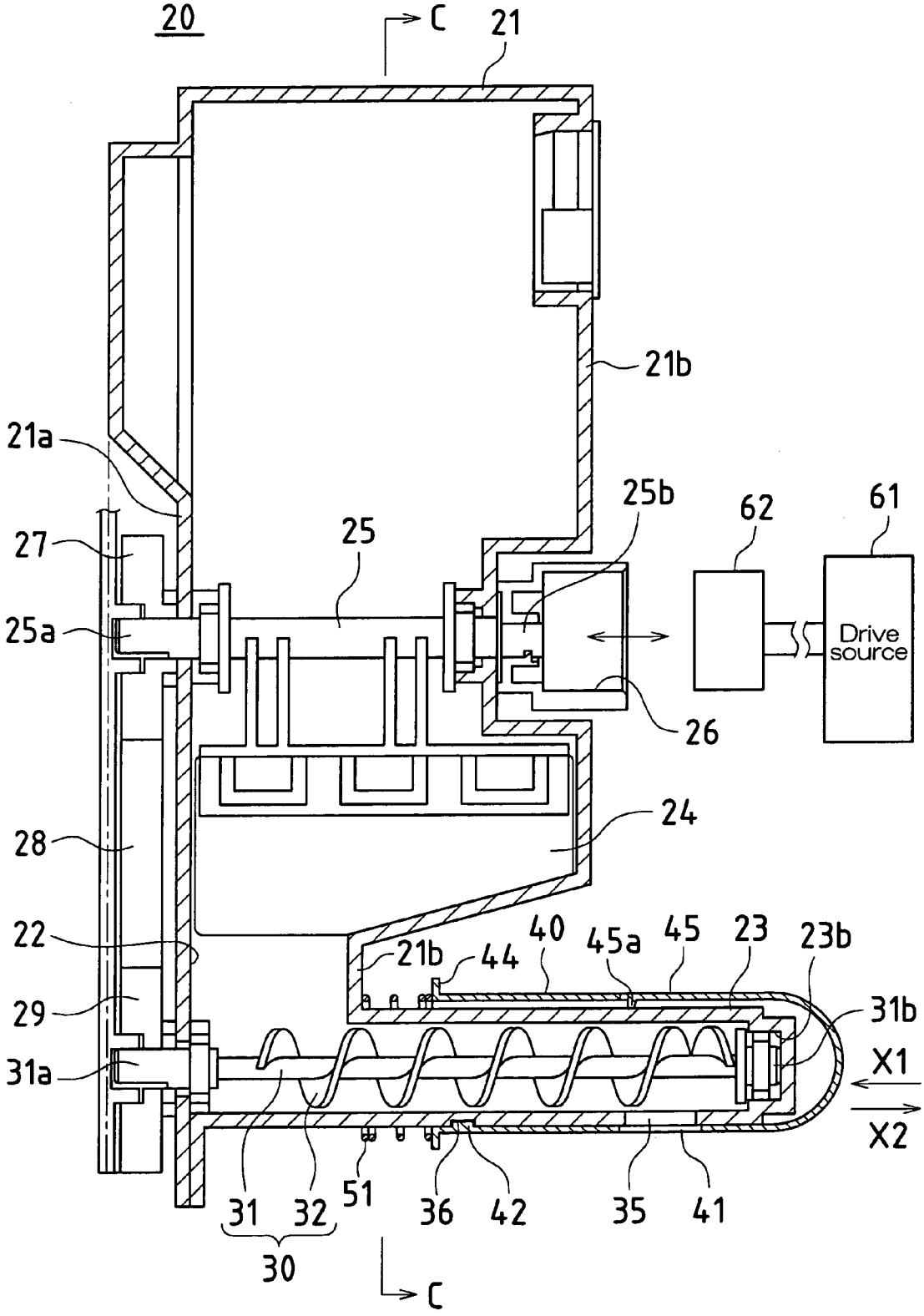
FIG. 2 is a schematic sectional diagram of a toner cartridge associated with the present invention as viewed from the side.
Figure 3:
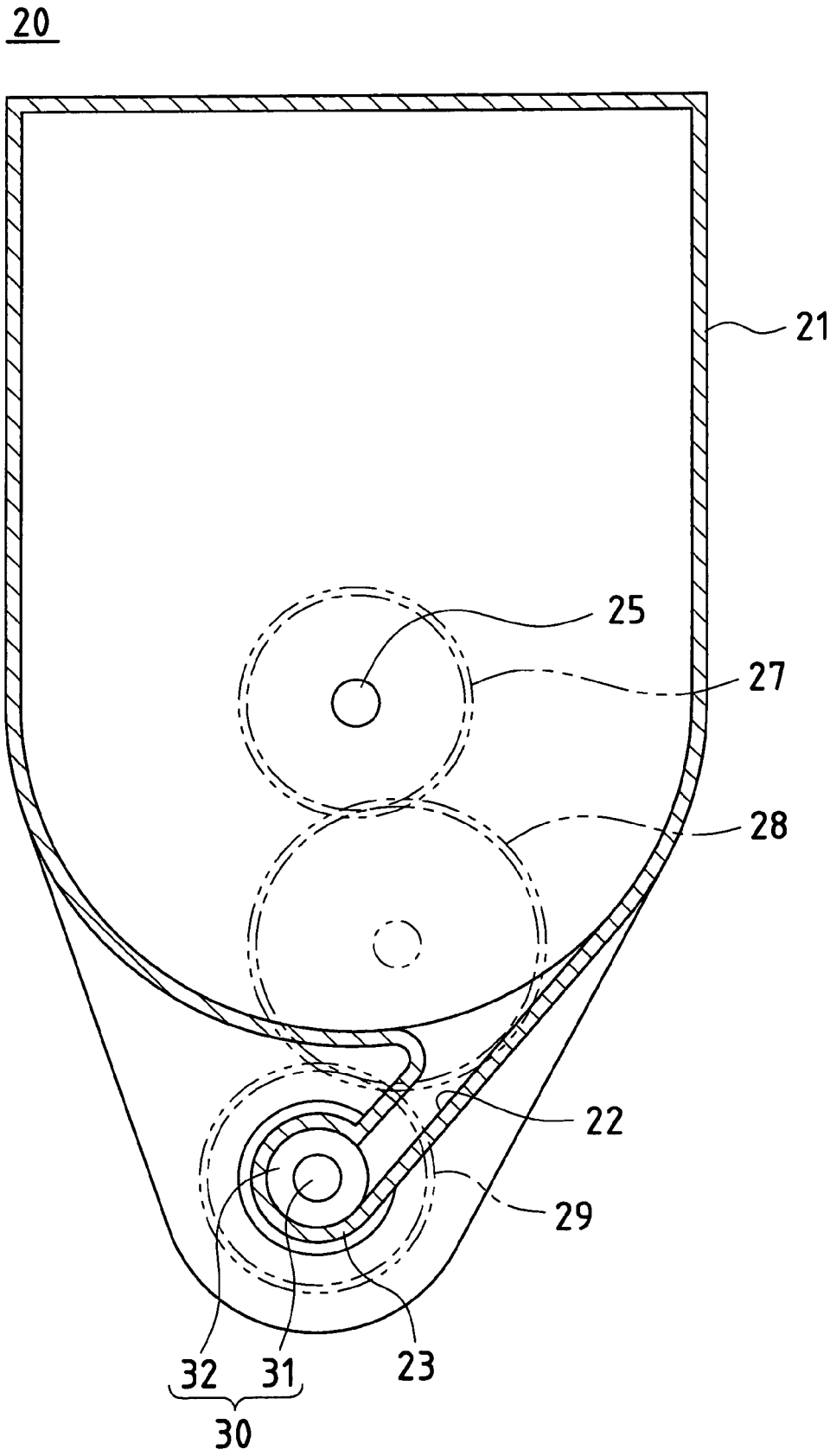
FIG. 3 is a schematic sectional view of section C—C shown in FIG. 2.
Figure 4:
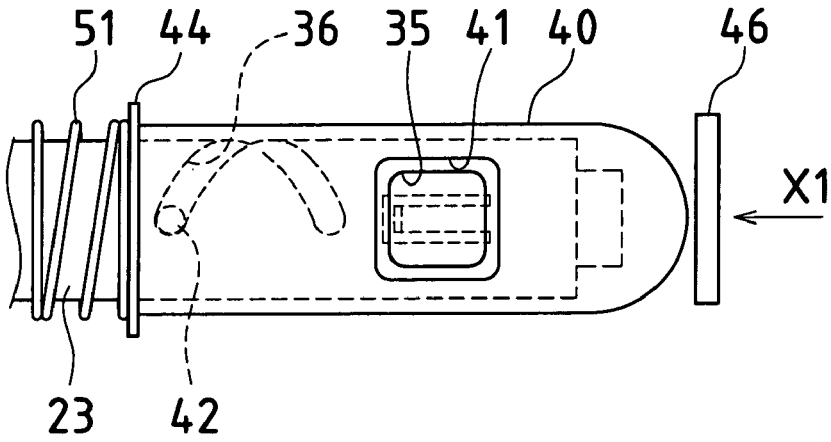
FIG. 4(*a*) is a partial enlarged bottom view showing positional relationship between toner particles discharge unit and shutter cap when the toner cartridge is loaded in the development apparatus main body.
Figure 4:
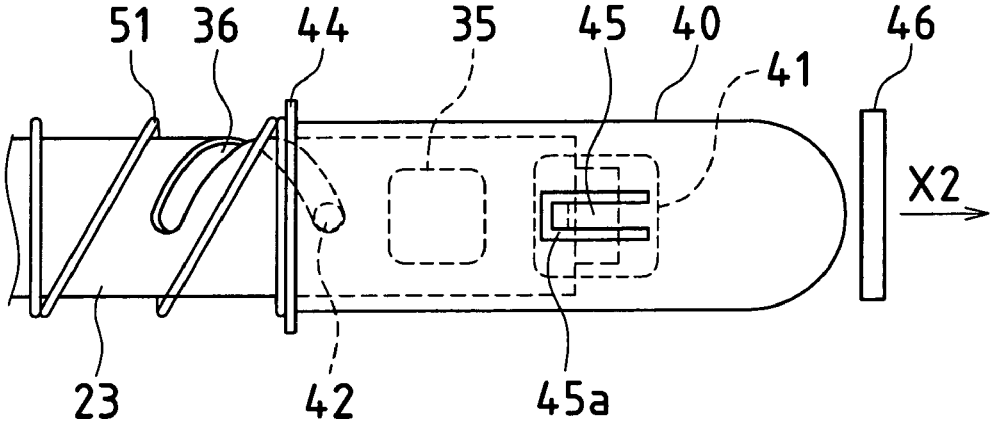
Figure 5:
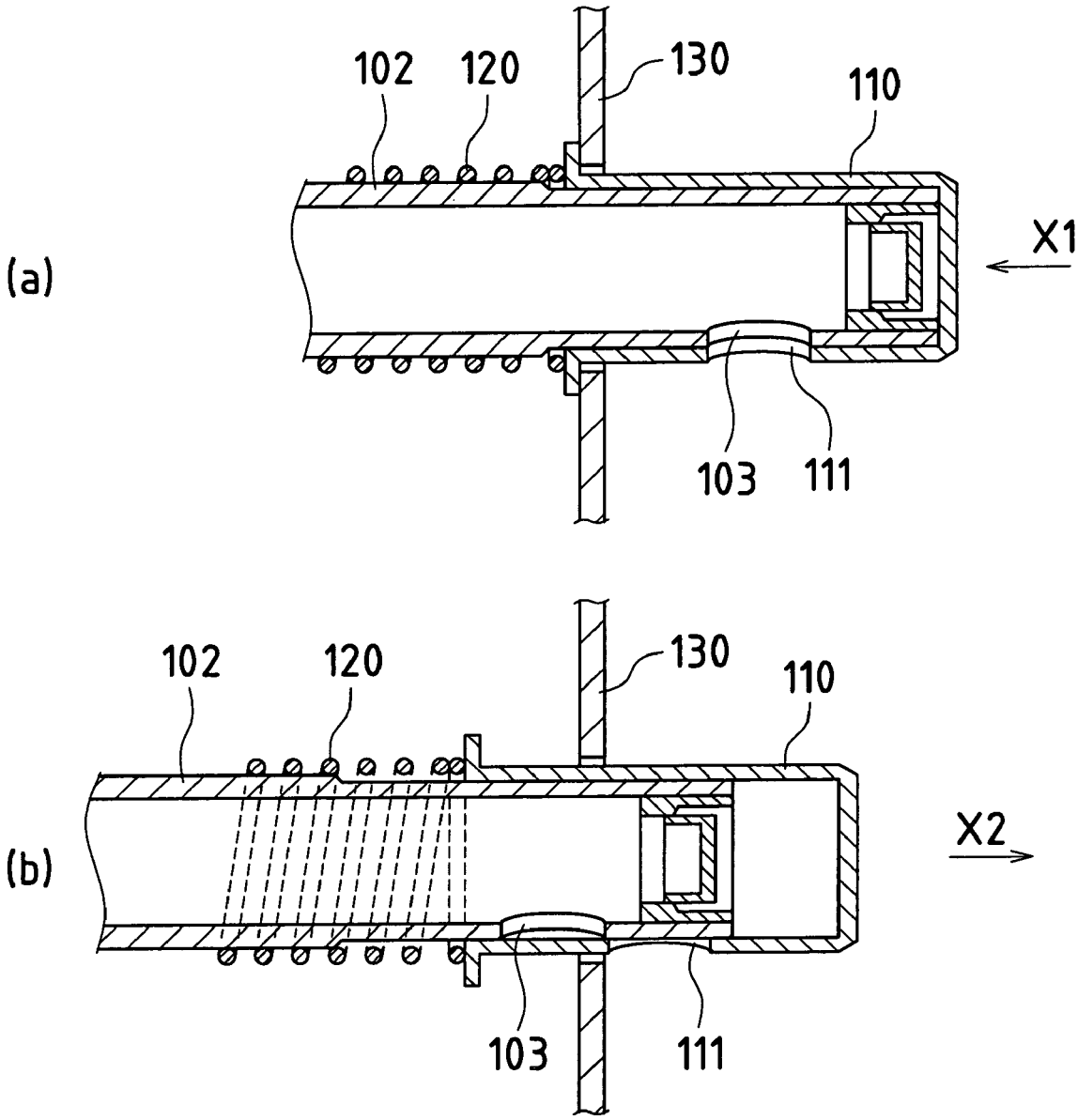
FIG.5 Prior Art
FIG. 5 is a partial enlarged sectional view showing construction in a conventional toner cartridge.
Figure 6:
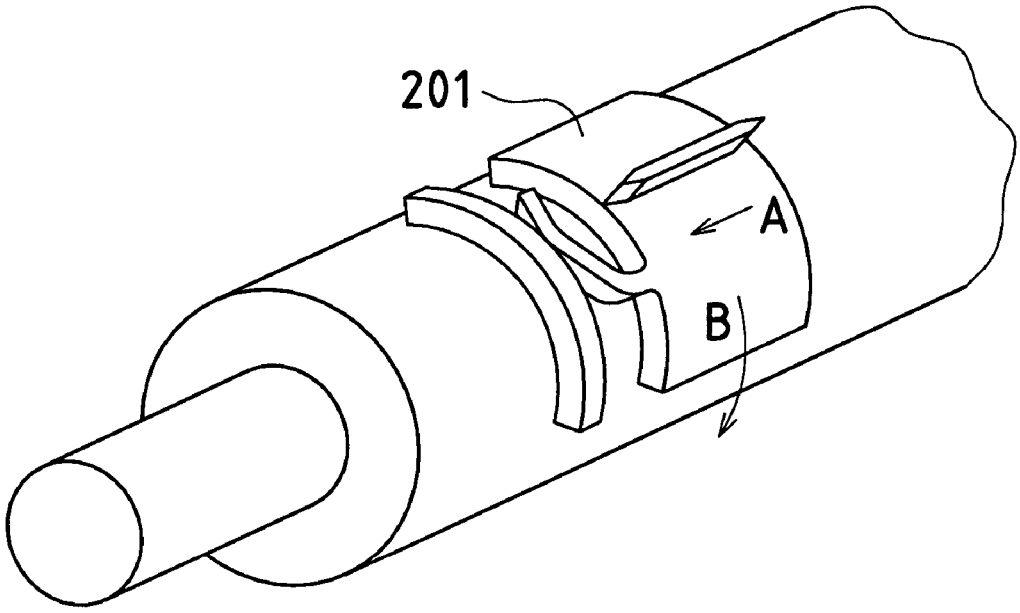
FIG.6 Prior Art
FIG. 6 is a partial enlarged oblique view showing another construction in a conventional toner cartridge.

FIG. 2 is a schematic sectional diagram of a toner cartridge associated with the present invention as viewed from the side; FIG. 3 is a schematic sectional view of section C—C shown in FIG. 2; FIG. 4 is a bottom view of a toner particles discharge unit.

This toner cartridge 20, primarily as shown in FIG. 2, is equipped with cartridge main body 21 containing toner, i.e., particles; moreover, provided below this cartridge main body 21, by way of intervening toner dispensing outlet 22, is cylindrical toner particles discharge unit 23 which is arranged horizontally. This toner cartridge 20 is removably installed in a development apparatus main body, not shown.

Provided within cartridge main body 21 in such fashion as to pass through the front and back sidewalls 21*a*, 21*b* of cartridge main body 21 is rotatable shaft 25, which supports agitator vane(s) 24 at the central portion thereof and which rotates. Moreover, female engagement gear 26, disengageably engaged with gear 62 which is linked to drive source 61, is provided at the back end 25*b* of rotatable shaft 25, which protrudes from back sidewall 21*b*; engagement gear 26 and gear 62 linked to drive source 61 constitute a clutch mechanism transmitting drive force. Furthermore, first gear 27 is attached to the front end 25*a* of rotatable shaft 25, which protrudes from front sidewall 21*a*.

Moreover, arranged within cylindrical toner particles discharge unit 23 is conveyor screw 30, which has helical conveyor vane(s) 32 secured to rotatable shaft 31. Back end 31*b* of rotatable shaft 31 is rotatably supported so as to be captured by recess 23*b* formed at the interior surface at the tip of toner particles discharge unit 23; front end 31*a* thereof is rotatably supported so as to pass through front sidewall 21*a* of cartridge main body 21. Furthermore, third gear 29 is attached to the front end 31*a* of rotatable shaft 31, which protrudes from front sidewall 21*a*. Furthermore, second gear 28, which links this third gear 29 to the aforesaid first gear 27, is attached to front sidewall 21*a*. That is, drive force from drive source 61 is transmitted to conveyor screw 30 by way of rotatable shaft 25 of agitator vane(s) 24, and first through third gears 27 through 29.

Toner particles discharge unit 23 constituted in such fashion is provided with toner particles discharge outlet 35 at the bottom of the circumferential sidewall at the tip portion thereof. Furthermore, mounted on this toner particles discharge unit 23 so as to cover the outside circumferential surface thereof is cylindrical shutter cap 40.

Shutter cap 40 is provided with opening 41 on the circumferential sidewall thereof for opening and closing toner particles discharge outlet 35 of toner particles discharge unit 23, and this shutter cap 40 is disposed so as to be capable of moving in substantially parallel fashion with respect to axial direction X (X1, X2) of toner particles discharge unit 23 while rotating in helical fashion.

That is, as mechanism for achieving helical motion in the present embodiment, groove 36 is formed on the outside circumferential surface of toner particles discharge unit 23 so as to wrap halfway around toner particles discharge unit 23 in helical fashion, and formed on the inside circumferential surface of shutter cap 40 in opposition thereto is sliding projection 42 which mates with and slides within groove 36. This will make it possible to cause shutter cap 40 to smoothly engage in helical motion while restricting the amount of rotation to one-half of a revolution. By thus causing shutter cap 40 to move so as to describe the locus of a helix, it is possible to open or close shutter cap 40 with a single operation; and furthermore, it is possible to achieve a construction which is such that shutter cap 40 is not easily opened even when an external force is inadvertently applied thereto from a particular direction (e.g., axial direction(s) X).

Furthermore, coil spring 51 is fitted onto the outside of toner particles discharge unit 23, this spring 51 being installed between wall 21*b* at the back of toner cartridge main body 21 and flange 44 formed at the edge of the opening at the front side of shutter cap 40. That is, the elastic reactive force from this spring 51 causes shutter cap 40 to be constantly acted upon by a restoring force in the direction indicated by arrow X2.

FIG. 2 and FIG. 4(*a*) show shutter cap 40 pressed thereinto in the direction indicated by arrow X1, with spring 51 in its compressed state, this being the state thereof when loaded into the development apparatus main body, not shown. That is, although not shown in the drawings, when toner cartridge 20 has been loaded into the development apparatus main body, shutter cap 40 abuts stopper 46 which is fixedly arranged on the frame portion, not shown, of the development apparatus main body—the state shown at FIG. 2 and FIG. 4(*a*) being the result when shutter cap 40 is pressed against the frame portion.

Furthermore, as shown at FIG. 2 and FIG. 4(*a*), the location of opening 41 provided on shutter cap 40 is set so as to cause opening 41 to line up with toner particles discharge outlet 35 of toner particles discharge unit 23 (i.e., so as to open toner particles discharge outlet 35) when shutter cap 40 is pressed thereinto in the direction indicated by arrow X1, with spring 51 in its compressed state.

On the other hand, when toner cartridge 20 is removed from the development apparatus main body, because pressure from stopper 46, which is fixedly arranged on the frame portion, is released, the elastic force of coil spring 51, as shown at FIG. 4(*b*), causes shutter cap 40 to move in the direction indicated by arrow X2 for a distance determined by the restriction represented by groove 36 as it turns one-half of a revolution. At such time, as a result of having turned one-half of a revolution, opening 41 of shutter cap 40 is made to move from its bottom position to a top position opposite toner particles discharge outlet 35, and toner particles discharge unit 23 is closed off by the inner wall of shutter cap 40. Thus, because opening 41 of shutter cap 40 is disposed so as to be moved upward by the elastic force from spring 51 when toner cartridge 20 is removed from the development apparatus main body, it is possible to prevent the problematic situation in which toner adhering to the region surrounding opening 41 of shutter cap 40 falls therefrom, soiling the surrounding area.

In addition, in the present embodiment, pressure-applying ridge 45 is formed in c-shaped fashion by deforming a portion of the circumferential sidewall (the circumferential sidewall at the top in FIG. 2; the circumferential sidewall at the bottom at FIG. 4(*b*)) opposite from opening 41 of shutter cap 40. In addition, tip 45*a* of this pressure-applying ridge 45 is formed so as to protrude toward the interior of shutter cap 40. Here, shutter cap 40 is itself formed from material having elasticity. That is, as a result of the fact that tip 45*a* of pressure-applying ridge 45 presses against the outside circumferential surface of toner particles discharge unit 23, the elastic force which pressure-applying ridge 45 itself possesses acts so as to cause opening 41 to constantly come in intimate contact with the outside circumferential surface of toner particles discharge unit 23. As a result, toner will not leak from opening 41 of shutter cap 40 even when toner is trapped between the outer circumferential surface of toner particles discharge unit 23 and the inner circumferential surface of shutter cap 40 as a result of rotation of shutter cap 40 in helical fashion for one-half revolution. Furthermore, because pressure-applying ridge (restoring force delivery means) 45 for causing opening 41 of shutter cap 40 to come in intimate contact with the outside circumferential surface of toner particles discharge unit 23 is, in the present embodiment, formed in c-shaped fashion by deforming a portion of the circumferential sidewall of shutter cap 40, it is possible to simplify the structure of the restoring force delivery means itself, and it is furthermore possible to simplify assembly of shutter cap 40 with respect to toner particles discharge unit 23.

Note, however, that the restoring force delivery means is not limited to this sort of pressure-applying ridge 45, it being possible to attain a similar restoring force by, for example, forming a recess on the inner circumferential surface opposite opening 41 of shutter cap 40, and arranging a coil spring between the inner circumferential surface of shutter cap 40 and the outer circumferential surface of toner particles discharge unit 23 such that one end of this coil spring is captured within this recess.

As described above, the particles supply apparatus of the present invention may be favorably employed in transport mechanism units transporting developer or waste developer in electrophotographic copiers, printers, or other such image forming apparatuses.

Moreover, the present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. A particles supply apparatus supplying particles, the particles supply apparatus comprising:

one or more cylindrical particles discharge units arranged horizontally beneath one or more containers containing particles, and provided with one or more particles discharge outlets at one or more lower portions thereof; and one or more cylindrical shutter caps covering at least one outside circumferential surface of at least one of the particles discharge unit or units;

wherein at least one of the shutter cap or caps is provided with one or more shutter openings for opening and/or closing at least one of the particles discharge outlet or outlets of at least one of the particles discharge unit or units, and is capable of moving in substantially parallel fashion with respect to at least one axial direction of at least one of the particles discharge unit or units while rotating in helical fashion.

2. A particles supply apparatus according to claim 1 wherein:

one or more helical grooves is or are formed on either at least one outside circumferential surface of at least one of the particles discharge unit or units or at least one inside circumferential surface of at least one of the shutter cap or caps; and one or more sliding projections mating with and sliding within at least one of the groove or grooves is or are formed on the other of the at least one outside circumferential surface of at least one of the particles discharge unit or units or the at least one inside circumferential surface of at least one of the shutter cap or caps.

3. A particles supply apparatus according to claim 1 wherein:

at least one of the shutter cap or caps is disposed such that at least one of the shutter opening or openings is positioned upward when at least one of the particles discharge outlet or outlets of at least one of the particles discharge unit or units is in a closed state.

4. A particles supply apparatus according to claim 3 wherein:

at least one of the shutter cap or caps is substantially constantly acted upon by at least one elastic member exerting at least one restoring force thereon in at least one direction tending to close at least one of the particles discharge outlet or outlets of at least one of the particles discharge unit or units.

5. A particles supply apparatus according to claim 1 wherein:

at least one of the shutter cap or caps is provided with at least one restoring force delivery means delivering at least one restoring force substantially constantly tending to cause at least one of the shutter opening or openings to come in intimate contact with at least one outside circumferential surface of at least one of the particles discharge unit or units.

6. A particles supply apparatus according to claim 5 wherein at least one of the restoring force delivery means is such that:

one or more pressure-applying ridges are formed in c-shaped fashion by deforming a portion of at least one circumferential sidewall opposite from at least one of the shutter opening or openings of at least one of the shutter cap or caps which is formed from at least one elastic material; and at least one of the pressure-applying ridge or ridges is formed so as to protrude toward the interior of at least one of the shutter cap or caps.

7. An image forming apparatus wherein at least one of the particles supply apparatus or apparatuses according to claim 1 is employed as at least one toner cartridge supplying toner to at least one development apparatus.

8. An image forming apparatus wherein at least one of the particles supply apparatus or apparatuses according to claim 2 is employed as at least one toner cartridge supplying toner to at least one development apparatus.

9. An image forming apparatus wherein at least one of the particles supply apparatus or apparatuses according to claim 3 is employed as at least one toner cartridge supplying toner to at least one development apparatus.

10. An image forming apparatus wherein at least one of the particles supply apparatus or apparatuses according to claim 4 is employed as at least one toner cartridge supplying toner to at least one development apparatus.

11. An image forming apparatus wherein at least one of the particles supply apparatus or apparatuses according to claim 5 is employed as at least one toner cartridge supplying toner to at least one development apparatus.

12. An image forming apparatus wherein at least one of the particles supply apparatus or apparatuses according to claim 6 is employed as at least one toner cartridge supplying toner to at least one development apparatus.

* * * * *